United States Patent [19]

Charonnat

[11] 4,245,941

[45] Jan. 20, 1981

[54] DEVICE FOR STORING AN ANGLE AND THE APPLICATION THEREOF TO THE HANDLING OF LOADS

[75] Inventor: Henri Charonnat, Reze, France

[73] Assignee: Brissonneau & Lotz Marine S.A., Carquefou, France

[21] Appl. No.: 938,495

[22] Filed: Aug. 31, 1978

[30] Foreign Application Priority Data

Sep. 9, 1977 [FR] France ..... 77 27295

[51] Int. Cl.[3] ..... B66C 13/04

[52] U.S. Cl. ..... 294/86 LS

[58] Field of Search ..... 414/137, 139, 626; 33/333, 384, 385, 386, 387, 388; 318/648, 649; 340/689; 254/81 SF, 67 DA

[56] References Cited

U.S. PATENT DOCUMENTS

| | | | |
|---|---|---|---|
| 741,801 | 10/1903 | Lemle | 33/387 |
| 3,947,970 | 4/1976 | Lesure | 333/387 X |

*Primary Examiner*—Stephen G. Kunin
*Assistant Examiner*—Terrance L. Siemens
*Attorney, Agent, or Firm*—Wenderoth, Lind & Ponack

[57] ABSTRACT

A device for seizing and handling a load which has a given inclination includes a frame which is adapted to be suspended at a point of the frame from a handling machine. The frame is adapted to be locked to the load. A device is provided for shifting the suspension point in a reference direction relative to the frame. A level detector is mounted on the frame to pivot in a vertical plane parallel to the reference direction and produces a signal when it deviates from a horizontal position. The device for shifting the suspension point is responsive to the signal and shifts the suspension point, upon the hoisting of the load, to a position in which the load cancels out the deviation from horizontality of the level detector. Regulating apparatus regulate the relative angular position of the detector relative to the frame in the vertical plane so as to bring the detector to a horizontal position in which it stores the given inclination of the load. A control device responsive to the signal of the detector controls the regulating apparatus in such manner as to automatically pivot the detector to the horizontal position prior to the hoisting of the load. A device inhibits the control device so as to maintain, in the course of the hoisting of the load, the level detector in the relative position in which it stores the given inclination of the load.

10 Claims, 10 Drawing Figures

DEVICE FOR STORING AN ANGLE AND THE APPLICATION THEREOF TO THE HANDLING OF LOADS

The present invention relates to an angle storing or memorizing device and the application of this device to the handling of loads, for example containers.

There are many technical fields in which it is desirable to memorize on an object the angle of inclination relative to the horizontal of a reference direction on a surface of this object in a given position of the latter. This is in particular the case of the handling of containers arranged in close rows on the deck or in cells of a ship.

Indeed, except in the case of certain containers filled with bulk material and in which the load is uniformly distributed, most containers have a load whose centre of gravity does not coincide with the geometric centre. This phenomenon, which is of little importance in the case of handling devices of containers suspended at four points, becomes preponderant in the case of handling devices hooked at a single point, for example with a crane. In this case, the hooking point of the handling device must be displaced in such manner as to raise the load under good conditions of horizontality; this function becomes fundamental in the case where the containers must be arranged in rows on board a ship on a deck or in cells since the geometric storage places of the containers are defined with very small tolerances, on the order of a few tens of millimeters. These tolerances permit a maximum inclination on the container, of about 0.6° before the latter is jammed by the uprights of the cells.

For maintaining a load such as a container or the like under such severe conditions of horizontality, a handling device is known of the type comprising a frame suspended at a point from a handling machine and adapted to be brought onto the load, means for locking the frame to the load, means for displacing said suspension point in a reference direction on the frame, a level detector placed in a vertical plane parallel to said reference direction and adapted to deliver an output signal when it has a defect of horizontality, and means responsive to said signal for controlling when the load is being hoisted, the displacement of said suspension point to a position in which it cancels out the defect of horizontality of the detector.

In this device the detector is parallel to the reference direction and the position of the suspension point is governed by the detector in order to maintain the two levels of the latter in the same horizontal plane, which signifies that the load is always maintained under perfect conditions of horizontality.

However, this device is not satisfactory in all cases since the angular position of a boat varies in accordance with its state of loading and ballasting and it is usually acknowledged that this angular position of the boat could reach 2°. Under these conditions, the uprights of the cells adapted to receive the containers are inclined to the vertical at an angle greater than 0.6° and consequently the maintenance of the container under the strict conditions of horizontality by means of the seizing device described above opposes the removal of this container from its cell.

An object of the invention is to provide a device for storing, on an object adapted to undergo displacements, the angle of displacement relative to the horizontal of a reference direction on a surface of this object in a given position of the latter.

Another object of the invention is to provide a load seizing device comprising such an angle storing device so as to in particular permit the handling of a container on board a ship on the deck or in cells, even when the angular position of this ship exceeds the maximum angle of relative inclination between the container and the uprights of the cells allowed by the manufacturing tolerances of these cells.

According to the invention, there is provided a device for storing, on an object adapted to undergo displacements, the angle of inclination relative to the horizontal of a reference direction on a surface of said object in a given position of the latter, wherein there are provided a support, a level detector pivotally connected to the support, means for locking the support to said object in a position in which the level detector is disposed substantially in a vertical plane which is parallel to or contains said reference direction, and means for regulating the position of the detector so as to bring it, in said given position of the object, to a horizontal position in which it stores said angle of inclination and maintains it in this position relative to the object.

According to the invention, there is also provided a seizing device of the type comprising a frame suspended at a point from a handling machine and adapted to be brought onto a load, for example a container, means for locking the frame to the load, means for displacing said point of suspension in a reference direction of the frame, a level detector placed in a vertical plane parallel to said direction and adapted to deliver an output signal when it has a defect of horizontality and means responsive to said output signal for controlling, upon the hoisting of the load, the displacement of said suspension point to a position in which it cancels out the defect of horizontality of the detector, wherein said frame and said detector constitute respectively the support and the detector of an angle storing device defined hereinabove, and the regulating means comprise means for actuating the detector, means for controlling said actuating means by the output signal of the detector so as to control, in the position in which the frame is placed on the load, the automatic tipping of the detector to its horizontal position prior to the hoisting of the load by said seizing device, and means for inhibiting the control means for maintaining, upon the hoisting of the load, the detector in its position with respect to the frame in which it stores the angle of position of the load.

The seizing device arranged in this way enables in particular a container whose centre of gravity is central or not central to be removed from a ship having cells and having an angular position exceeding the maximum relative inclination between the container and the uprights of the cells allowed by the tolerances of the cells, owing to the fact that owing to the prior positioning of the pivotal detector, and then that of the point of suspension when hoisting, the walls of the container remain constantly parallel to the uprights of the cells during the hoisting of the container. This device is of particular interest in the case of hoisting containers stored in cells since, in use, the jamming of the containers and the cells always occur when carrying out unloading operations, and moreover, in the course of this handling, the crane driver does not necessarily see the bottom of the cell and consequently cannot manually correct the inclination of the seizing device by a direct control of the displacement of the point of suspension.

Further features and advantages of the invention will be apparent from the ensuing description of an embodiment of a container seizing device having a storage of an angle which is given solely by way of example and illustrated in the accompanying drawings in which.

Figure 1:
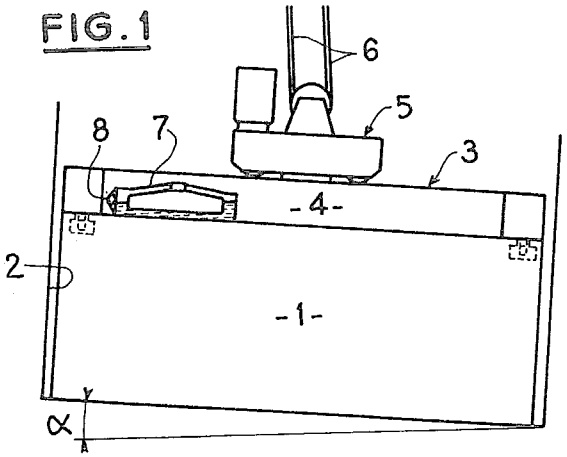
FIG. 1 is a diagrammatic elevational view of a seizing device according to the invention mounted on a container disposed in a cell of a ship having a large angular position or trim.

With reference first to FIGS. 1 to 4, which show the different stages of the hoisting of a container 1 out of a cell 2 of a ship (not shown) having a large inclination of angular position represented by the angle $\alpha$. As shown in FIG. 1, the seizing device 3 comprises essentially a frame 4 which bears on the container 1, a carriage 5 hooked by a cable 6 to a handling machine (not shown) and capable of being moved along the median longitudinal axis of the frame 4, and a level detector 7 which is pivotally mounted on the frame 4 to pivot about a pin 8 at one of its ends so as to be capable of tipping in a vertical plane parallel to said median longitudinal axis.

In a position shown in FIG. 1, the seizing device 3 has just been brought onto the container 1 and merely bears against the latter. The detector 7 which was initially parallel to said median axis, then has a defect of horizontality equal to the angle $\alpha$.

Figure 2:
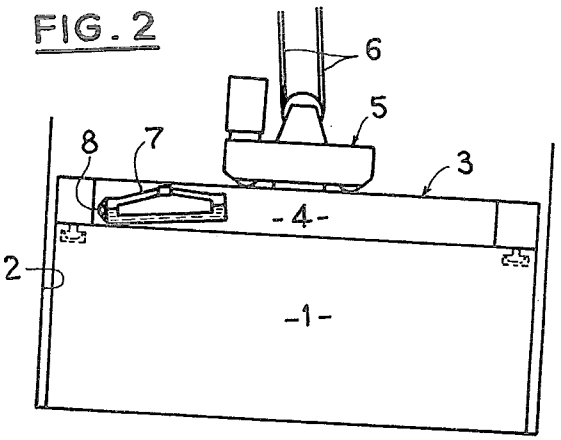
FIG. 2 is a view similar to FIG. 1 of the detector after it has been returned to the horizontal position.

However, the fact that the seizing device 3 bears against the container 1 initiates, as described in more detail hereinafter, means for actuating the detector 7 so as to bring the latter to its horizontal position as shown in FIG. 2, that is to say the detector 7 stores or memorizes the angle $\alpha$ of the container and the ship. During the stage, the seizing device 3 is locked to the container 1 and the crane driver then initiates the hoisting of the assembly.

Figure 4:
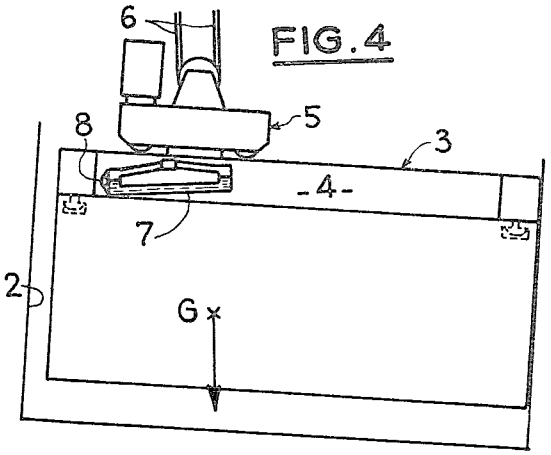
FIG. 4 is a view similar to FIG. 3 of the carriage in the position it occupies after having cancelled out the defect of horizontality of the detector.
Figure 3:
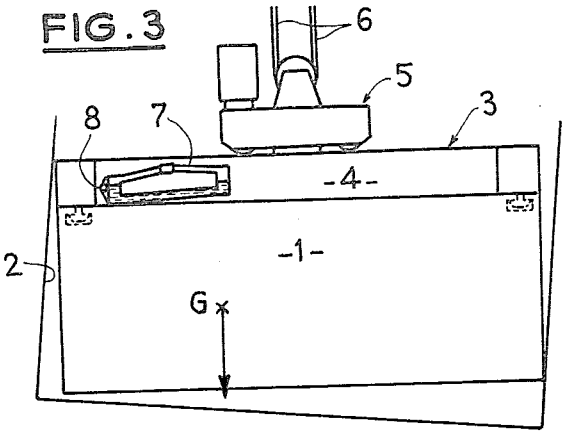
FIG. 3 is a view similar to FIG. 2 of the device at the start of the hoisting operation.
Figure 5:
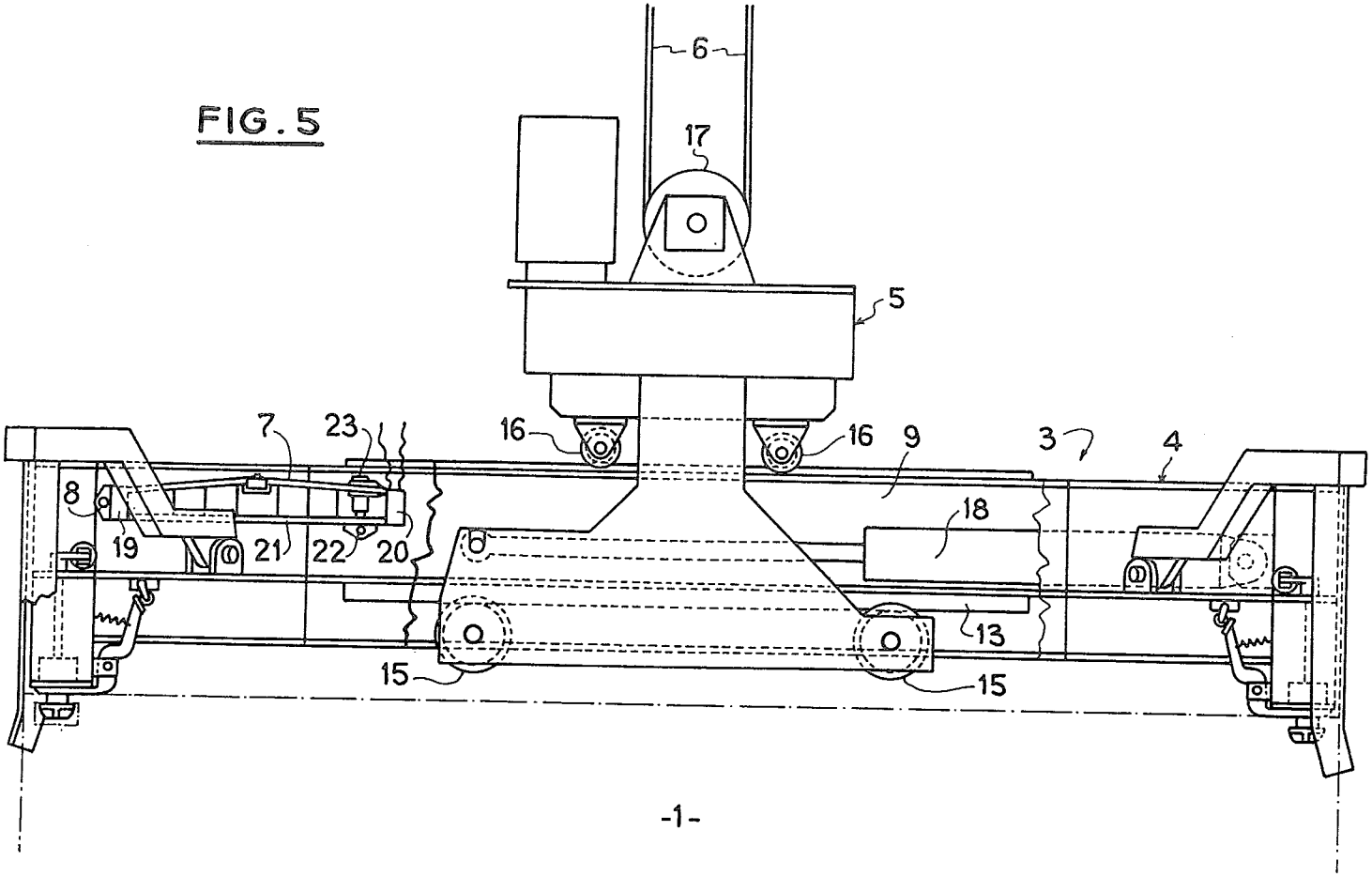
FIG. 5 is an elevational view, in more detail and with parts cut away, of the seizing device according to the invention.
Figure 6:
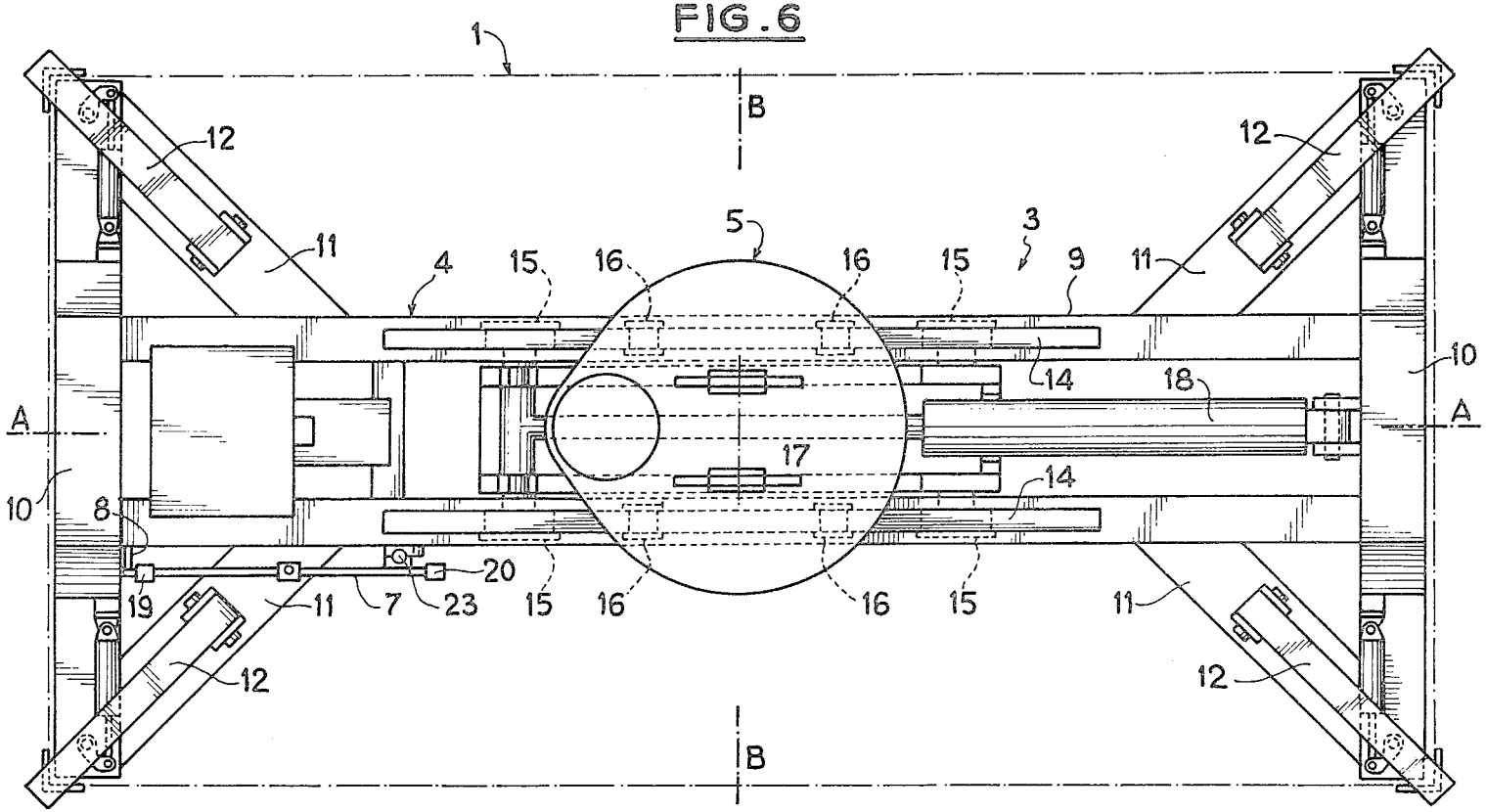
FIG. 6 is a top plan view of the seizing device shown in FIG. 5.
Figure 7:
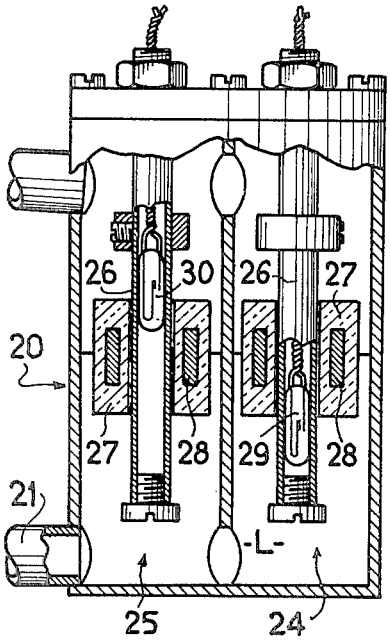
FIG. 7 is an elevational, view with a part cut away, of one end of the level detector.

As, apart from an exceptional coincidence, the carriage 5 is not then in vertical alignment with the centre of gravity G of the container 1, the latter tips about its point of suspension and abuts the lateral walls of the cell 2 as shown in FIG. 3. The control circuits for controlling the carriage, which are described hereinafter, then operate to displace the carriage to a position in which the level detector which has become fixed relative to the frame 4, is returned to the horizontal position and in which the container consequently resumes the initial inclination $\alpha$ equal to the angular position of the ship, as shown in FIG. 4. The container 1 can then be hoisted from the ship with no problem.

Reference will now be made to FIGS. 5 to 9 which show a preferred embodiment of the seizing device according to the invention. This seizing device 3 comprises a frame 4 which, on the whole is similar to that described in the U.S. Pat. No. 4,179,149. This frame 4 comprises a centre beam or girder 9 which is rigid at each end with a section member 10 whose ends together define the four corners of a rectangle of the same dimension as the containers 1 to be raised. Four reinforcing section members 11 disposed obliquely between the centre girder 9 and the ends of the section members 10 each carry a centering arm 12 of the type described in the aforementioned U.S. patent.

The centre girder 9 carries on its lower side a pair of rails 13 and on its upper side a pair of rails 14 whereby the carriage 5 can roll along the girder 9 by means of two pairs of lower rollers 15 and two pairs of upper rollers 16. The carriage 5 therefore supports the frame 4 and it is itself suspended from the handling machine (not shown) by the cable 6 which passes around two pulleys 17 which are disposed symmetrically on each side of the median longitudinal axis A—A of the frame, along which the carriage 5 can roll. This arrangement permits avoiding the inclination of the frame 4 on its median transverse axis B—B but, notwithstanding the presence of the two pulleys 17, it may nonetheless be likened to a hooking at a single point with respect to its possibilities of inclination on its median longitudinal axis A—A. The displacement of the carriage 5 along the centre girder 9 is controlled by a double-acting hydraulic jack 18 which is pivotally mounted at one of its ends on the frame 4 and at its other end on the carriage 5.

The level detector 7 comprises essentially two liquid tanks 19, 20 spaced from each other and put in communication in their lower part by a pipe 21. The detector 7 is disposed parallel to the girder 9 on which it is mounted at one of its ends to pivot about the pin 18 which is parallel to the general plane of the frame 4 and orthogonal to its median longitudinal axis A—A. The detector 7 is pivotally mounted at 22, in the vicinity of its other end, on the end of the piston of a double-acting hydraulic jack 23 whose body is fixed to the centre girder 9. The tank 20 of the detector 7 located adjacent the jack 23 is divided into two compartments 24, 25 which communicate with each other and in each of which plunges a fluidtight pipe 26 along which is slidably mounted a float 27 in which is embedded a permanent magnet 28. An electric blade switch is disposed in each of the fluid-tight pipes 26, one, 29, in the lower part of one of the pipes and the other, 30, in the upper part of the other pipe. The two switches 29, 30 are disposed at sufficient distance from each other in the vertical direction so that, when the detector 7 is in the horizontal position, the floats 27 are, one, just below the upper switch 30, and, the other, just above the lower switch 29, so that none of the two switches is closed in this position. On the other hand, if the tank 20 containing the two floats is lower than the other tank 19, the level of the liquid L is higher in the tank 20 and the floats 27 rise so that the upper switch 30 is closed by the magnet 28 of the associated float. Inversely, if the tank 20 is at a higher level than the other tank 19, it is the other switch 29 which is closed.

Figure 8:
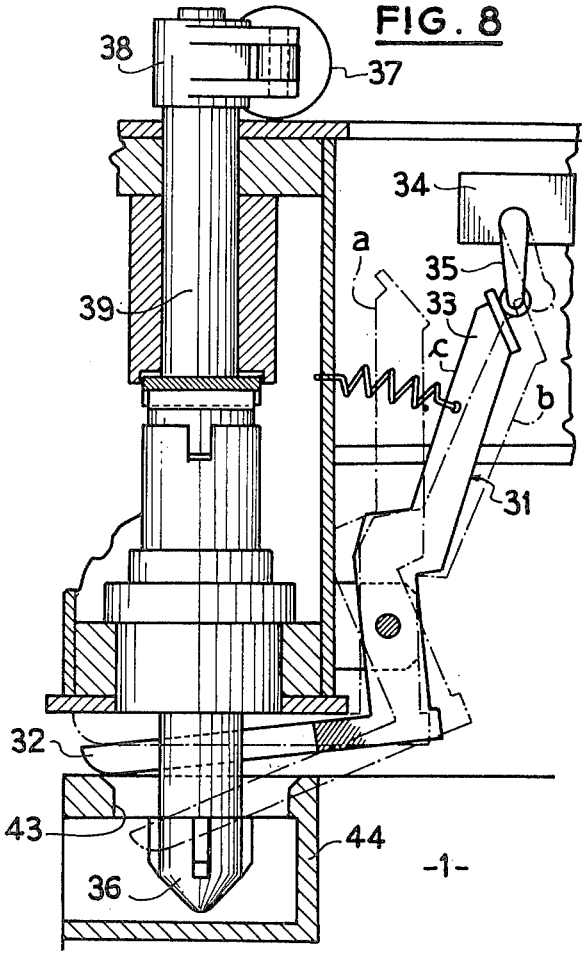
FIG. 8 is a sectional view of details of a corner of the seizing device showing the means for locking this device to a container and means for detecting when the seizing device bears against the container.
Figure 9:
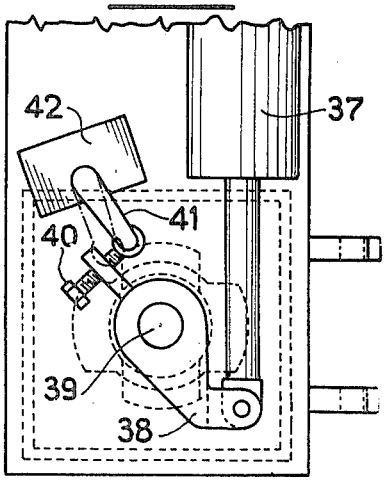
FIG. 9 is a detail plan view of the means for locking the seizing device to a container and means for detecting the end of the locking.

With reference now to FIG. 8, in each of the lower corners of the frame 4 there is pivoted to an arm 31 which is substantially in the shape of an L forming a sensor one of the branches 32 of which projects under the frame 4 and the end of the other branch 33 of which cooperates with a switch 34 the function of which will be explained hereinafter. The arms 31 disposed in the other corners cooperate in the same way with switches 34', 34'', 34'''. When the seizing device 3 supports no container, the weight of the lower branch 32 of the arms 31 and the spring R causes them to assume their first position a represented in dot-dash lines in which the switches are open. When the seizing device 3 has just been placed on a container, the lower branch 32 of the L-shape is biased upwardly by the top of the container 1 and assumes, when the seizing device completely bears on the container, its second position b shown in dot-dash lines. In its second position b, the upper branch 33 of the L-shape has displaced the control lever 34 of the switch to its position shown in dot-dash lines and the latter is then closed. Lastly, when, after having locked the seizing device 3 to the container 1, the assembly comprising the seizing device and the container is raised, they separate from each other a predetermined distance corresponding to the longitudinal clearance of the locks (described hereinafter), and the L-shaped arm 31 is then returned by the spring R to its position c shown in full lines and in which the switch is once more open. Each lock disposed at a corner of the frame 4 comprises an oblong bolt 36 which projects under the lower side of the frame 4 and which can be turned between two positions which are offset from each other 90° by means of a jack 37 which is pivotally mounted on the chassis 4 and on the end of an arm 38 rigid with a rod 39 controlling the bolt 36. Each arm 38 comprises an abutment 40 corresponding to the end of the locking. Thus, when the seizing device 3 is brought above a container 1, the jack 37 is in the withdrawn position and the lever 41 of the switch 42 which is not in contact with the abutment 40 is open. Thereafter, when each of the bolts 36 has entered the oblong slot 43 of the corresponding corner box 44 forming a keeper of the container 1, the four jacks 37 are simultaneously actuated so as to turn the bolts 36 through 90° and thereby lock the seizing device 3 to the container 1. The abutments 40 then displace the levers 41 controlling the switches 42 from the position shown in dot-dash lines to the position shown in full lines in FIG. 9 in which the switches are closed. The switches 42 remain thereafter closed so long as the seizing device 3 is locked to a container 1.

Figure 10:
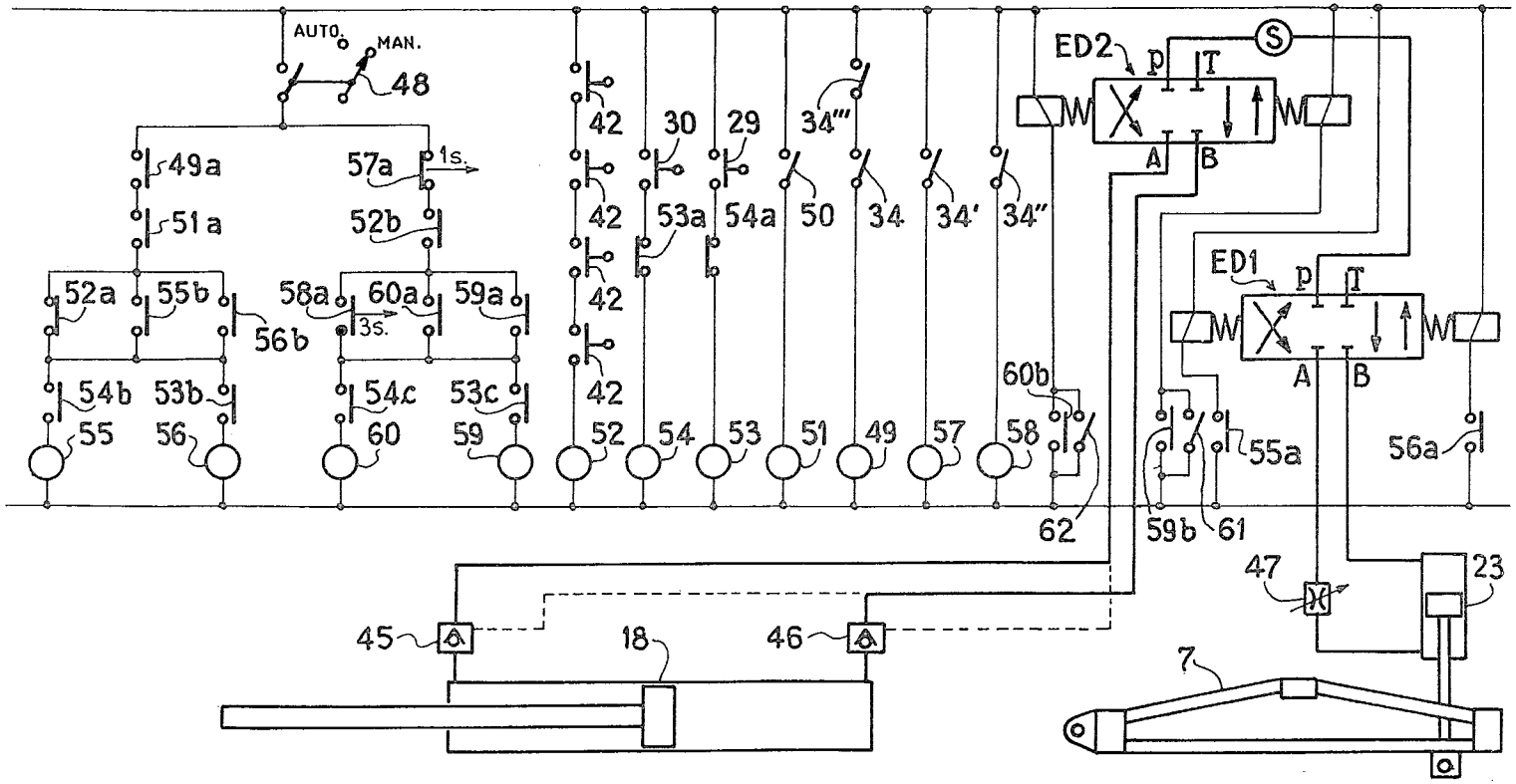
FIG. 10 is a diagram of the principle of the electrohydraulic circuit associated with the seizing device according to the invention.

With reference now to FIG. 10, which is a diagram of the principle of the electrohydraulic circuit associated with the seizing device 3, this circuit comprises two electrically operated distributor valves $ED_1$ and $ED_2$ having four ways, respectively associated with the jack 23 controlling the inclination of the detector 7 and the jack 18 controlling the translation of the carriage 5. Each distributor valve comprises an orifice P connected to a source of hydraulic pressure S, an orifice T connected to a tank (not shown) for releasing the pressure, an orifice A connected to one side of the jack and an orifice B connected to the other side of the jack relative to the piston. Further, check valves 45, 46 are disposed in the pipes extending respectively between the orifices A and B of the distributor valve $ED_2$ and the two sides of the jack 18 whereas a variable throttle 47 is disposed in the pipe extending between the orifice A of the distributor valve $ED_1$ and the lower chamber of the jack 23. Each electrically operated distributor valve is supplied with power by an electric supply source of 110 Volts through two moving relay contacts capable of being closed under the conditions described hereinafter.

When the seizing device 3 has descended on top of a container 1, the slide valve member of the distributor valve $ED_1$ is in the central position for closing and the jack 23 is maintained in the position it occupies. Likewise, the slide valve member of the distributor valve $ED_2$ is in the central closed position.

The circuit is brought into action by a switch 45 which controls the passage from a "manual" position to an "automatic" position corresponding to its closure. When the seizing device 3 is placed on a container 1, the switches 34, 34', 34'', 34''' are closed by the sensors 31, the closure of two of the switches, namely 34 and 34''' ensuring the supply of current to the winding of a relay 49, whose moving contact 49*a*, which is normally open and connected in series with the switch 48 is closed. The operator then closes a switch 50 which supplies current to a relay controlling the locking 51, whose normally open moving contact 51*a*, connected in series with the switch 49*a*, is closed. This switch 51*a* is itself connected in series with the normally closed moving contact 52*a* of a relay 52 corresponding to the end of the locking travel whose coil is connected in series with the four switches 42. Moreover, the switches 29 and 30 of the detector 7 are respectively connected in series with the coils of two relays 53 and 54. The relay 53 comprises a moving contact 53*a* which is normally closed and located between the switch 30 and the coil of the relay 54, and the relay 54 comprises a moving contact 54*a* which is normally closed and is located between the switch 29 and the coil of the relay 3.

Consequently, if at this stage of the operations the detector 7 is inclined so that its tank 20 is disposed lower than its tank 19, the switch 30 is closed and the relay 54 is supplied with current. The switch 29 is, on the other hand, open, and the relay 53 is not supplied with current. The contact 53*a* therefore remains closed whereas the contact 54*a* opens. The supply of current to the relay 54 causes the closure of another normally open moving contact 54*b* of this relay which is connected in series with the contact 52*a*. Another moving contact 53*b* which is normally open of the relay 53 which is connected in parallel with the contact 54*b* on the other hand remains open. The closure of the contact 54*b* causes the supply of current to a relay 55 with the coil of which it is connected in series. This relay 55 comprises a normally open moving contact 55*a* the closure of which ensures the excitation of the electrically operated distributor valve $ED_1$ in the direction adapted to apply the pressure from P to A and release the pressure from B to T. The piston of the jack 23 is therefore urged upwardly and consequently the tank 20 is also urged upwardly until the detector 7 assumes its horizontal position in which the switch 30 opens. The relay 34 is no longer supplied with current and the movement of the piston stops and the detector 7 remains in the horizontal position.

If, on the other hand, it is the tank 20 which is initially higher than the tank 19, it is the switch 29 which is closed and the operation of the relays 53 and 54 is reversed. In order to ensure this reverse operation, there is provided a relay 56 whose coil is connected in series with the contact 53*b* and whose moving contact 56*a* controls the supply of current to the electrically operated distributor valve $ED_1$ so as to apply the pressure of P to B and release the pressure of A to T and permit the descent of the piston of the jack 23.

The detection of the position of the detector 7 occurs during the locking travel of the bolts 36. At the end of this travel, the contact 52*a* of the relay corresponding to the end of the locking opens. However, in order to avoid that the started correction of the position of the detector 7 be then interrupted, two normally open contacts 55*b*, 56*b*, connected in parallel with the contact 52*a* and controlled respectively by the relays 55 and 56, are provided. During the stage for detecting the position of the detector 7, either of the contacts 55*b* and 56*b* is always closed, since one of the relays 55, 56 is supplied with current. Consequently, after the opening of the contact 52*a*, the aforementioned correction can continue since one of the relays 55 or 56 continues to be supplied with current through one of the contacts 55*b* or 56*b* until the horizontal position of the detector 7 has been reached. The supply of current to the relays 53 or 54 and 55 or 56 is then stopped.

The operator then initiates, by means of the handling machine, the hoisting of the seizing device 3 which is locked to the container 1. This hoisting causes the opening of all the switches 34, 34', 34'', 34''' and consequently the opening of the moving contact 49*a*, as the relay 49 is no longer supplied with current. One of the switches 34' is connected in series with the coil of a time delay relay 57 whose moving contact 54*a* is normally closed and connected in parallel with the circuit consisting of the moving contacts 49*a*, 51*a*, 52*a*, 55*b*, 56*b*, 54*b*, 53*b* and the coils of the relays 55 and 56. As the coil of the relay 57 was supplied with current during the preceding stage of correction of horizontality of the detector 7, the moving contact 57 is closed with a delay of one second with respect to the opening of the associated switch 34' due to the timing of the relay. Moreover, one of the other switches, namely, switch 34'' is connected in series with a time delay relay 58 whose normally open moving contact 58*a* is connected in series with the moving contact 57*a*. This relay is adapted to maintain its moving contact 58*a* closed during a period of three seconds from the stoppage of the supply of current thereto. Consequently, the moving contacts 57*a* and 58*a* are simultaneously closed between the first second and the third second counted from the opening of the switches 34', 34'', that is to say substantially from the start of the hoisting. Further, the relay 52 corresponding to the end of the locking comprises a second moving contact 52*b* which is normally open and connected in series between the contacts 57*a* and 58*a*. As the relay 52 is supplied with current through switches 42 then closed, the moving contact 52*b* remains closed so long as the seizing device 3 is locked on a container 1.

Starting at the moving contact 58*a* there are connected in parallel coils of two relays, one, 59, being supplied with current through a normally open moving contact 53*a* of the relay 53, and the other, 60, through a normally open moving contact 54*c* of the relay 54. The relays 59 and 60 each comprise a normally open moving contact 59*a*, 60*a* respectively connected in parallel with the contact 58*a* and normally open moving contact 59*b*, 60*b* respectively, connected in the supply circuit of the electrically operated distributor valve $ED_2$.

As mentioned before, between the first second and the third second which follow the hoisting, the contacts 57*a*, 52*b* and 58*a* are closed. During this period, the container 1 assumes a new angular position which, as already explained above, causes a new inclination of the detector 7. If the tank 20 is once again lower than the tank 19, the switch 30 is closed and ensures the supply of current to the relay 54. As a result, the contact 54*c* closes, and consequently current is supplied to the relay 60 which, in turn, closes the contact 60*b*. The electrically operated distributor valve $ED_2$ is then supplied with current on the side which tends to apply the pressure of P to A and release the pressure from B to T. This causes the piston of the jack to move toward the right, as viewed in FIGS. 5 and 10, that is to say, in the direction which tends to displace the carriage 5 in the direction of the lower end of the frame 4. This movement is continued until the levels of the detector 7 have returned to the horizontal position upon which the switch 30 opens and the distributor valve $ED_2$ returns to its central position in which it maintains the piston of the jack 18 in its new position. The correction of the angular position of the container 1 can continue after the end of the period of three seconds following the start of the hoisting, notwithstanding the opening of the moving contact 58*a*, due to the fact that one of the moving contacts 59*a* or 60*a*, namely 60*a* in the case of current supply to the relay 60, was already closed. When equilibrium has been reached, this contact opens and the angular position of the container can no longer be modified in the course of the continuance of the hoisting operation. It will be understood that if the container 1 is inclined in the opposite direction, the operation of the circuit is absolutely similar, the relays 53 and 59 being supplied with current to cause the displacement of the piston of the jack 18 in the other direction.

The foregoing description concerns the operation of the circuit for the automatic correction of the horizontality of the detector 7 and of the angular position of the container 1, in the case where the container has initially a certain inclination that must be conserved for hoisting it out of a cell of a ship. On the other hand, if, initially the container is disposed horizontally on a quay side or other surface before loading into a ship having a certain angular position, the inclination of the assembly comprising the seizing device and the container is always possible by translation of the carriage 5. For this purpose, two normally open switches 61, 62 are provided which are connected, one in parallel with the moving contact 59*b* and the other in parallel with the moving contact 60*b*, so as to excite the electrically operated distributor valve $ED_2$ selectively.

Having now described my invention what I claim as new and desire to secure by Letters Patent is:

1. A seizing device of the type comprising a frame, movable means for suspending the frame at a point from a handling machine and for bringing the frame onto a load, for example a container, means for locking the frame to the load, means for displacing said point of suspension in a reference direction of the frame, a device for storing on the load an angle of inclination relative to the horizontal of said reference direction in a given position of the load, said storing device comprising said frame, a level detector pivotally mounted on the frame, means for locking the frame to the load in a position in which position the level detector is disposed substantially in a vertical plane which extends in the same direction as said direction, the detector comprising means for delivering an output signal when there occurs a defect of horizontality of the level detector and means responsive to said output signal for displacing, in the course of the hoisting of the load, said point of suspension relative to the frame to a position where it cancels out the defect of horizontality of the level detector, regulating means for regulating the angular position of the level detector in said plane so as to bring the level detector, in said given position of the load, to a horizontal position in which it stores said angle of inclination and maintains the level detector in the relative position relative to the load, the regulating means comprising pivoting means for pivoting the detector, control means for controlling said pivoting means by the output signal of the detector in such manner as to automatically pivot, in the position in which the frame is placed on the load, the level detector to the horizontal position of the level detector prior to the hoisting of the load by said seizing device, and means for inhibiting the control means so as to maintain, in the course of the hoisting of the load, the level detector in said relative position with respect to the load in which it stores the angular position of the load.

2. A seizing device as claimed in claim 1, wherein said pivoting means includes a double-acting first actuating jack carried by the frame and including a piston, said detector having one end pivotally connected to the frame and an opposite end connected to the piston.

3. A seizing device as claimed in claim 2, wherein the detector includes a first switch and a second switch and two floats which are respectively combined with to be capable of closing one and the other of the switches when the detector is inclined to the horizontal respectively in one direction and in the other direction.

4. A seizing device as claimed in claim 3, wherein said control means include a first electrically operated distributor valve connected to the first jack for supplying hydraulic fluid to the first jack, an electric circuit connected to control the distributor valve, first and second switches for controlling said distributor valve so as to supply fluid to the first jack in the direction which tends to return the detector to the horizontal position thereof.

5. A seizing device as claimed in claim 4, including at least one first sensor for detecting when the seizing device bears on the load and at least a third switch associated with the first sensor and connected in said electric circuit, said sensor being capable of closing the third switch in a position in which the seizing device bears on the load and authorize the opening of the third switch in a position in which the seizing device is locked to the load and in suspension.

6. A seizing device as claimed in claim 4, wherein the load has corner boxes, the frame has corners and the means for locking the frame to the load comprise at each corner of the frame a rotatable oblong bolt adapted to be received with a certain longitudinal clearance in a corner box of the load and means for shifting said bolt, said sensor comprising an L-shaped arm having a branch which extends under a lower side of the frame and a second branch which is pivotally mounted on the frame and cooperate with said third switch at an end of the second branch.

7. A seizing device as claimed in claim 6 comprising at least one fourth switch connected in said electric circuit, the means for shifting at least one of the bolts being associated with the fourth switch which fourth switch is closed by said shifting means at the end of a locking travel of the bolt, so as to tend to render said control circuit of the electrically operated distributor valve inoperative upon the termination of said automatic pivoting of the detector to the horizontal position of the detector.

8. A seizing device as claimed in claim 7, wherein said electric circuit comprises a first relay and a second relay each having a first moving contact for controlling the excitation of the first electrically operated distributor valve and a second moving contact for overcoming the tendency of the fourth switch to render said control circuit inoperative, until the termination of said automatic pivoting of the detector to the horizontal position of the detector.

9. A seizing device as claimed in claim 8, comprising a second double-acting jack for controlling the displacement of the point of suspension, a second electrically operated distributor valve associated with the second double-acting jack for controlling the supply of hydraulic fluid to the second jack and an electric circuit controlling the second electrically operated distributor valve, a second sensor and a third sensor and a third time delay relay and a fourth time delay relay, said second electric circuit comprising a fifth switch and a sixth switch respectively associated with the second sensor and the third sensor and with the third time delay relay and the fourth time delay relay for allowing the supply of current to the second electric circuit during a predetermined period of time after the start of the hoisting of the seizing device locked to the load.

10. A seizing device as claimed in claim 9, wherein the second electric circuit comprises a fifth relay and a sixth relay each having a first moving contact for controlling the excitation of the second electrically operated distributor valve and a second moving contact for allowing the continuance of said displacement of the point of suspension toward the position for cancelling out the defect of horizontality of the detector after the completion of said period of time.

* * * * *